US007494025B2

(12) United States Patent
Porter

(10) Patent No.: US 7,494,025 B2
(45) Date of Patent: Feb. 24, 2009

(54) INTERNAL COVER FOR ENCLOSING CONTAINER CONTENTS

(75) Inventor: Mark D. Porter, Missoula, MT (US)

(73) Assignee: Planetary Design, LLC, Missoula, MT (US)

( * ) Notice: Subject to any disclaimer, the term of this patent is extended or adjusted under 35 U.S.C. 154(b) by 729 days.

(21) Appl. No.: 11/056,956

(22) Filed: Feb. 14, 2005

(65) Prior Publication Data

US 2006/0180591 A1 Aug. 17, 2006

(51) Int. Cl.
*B65D 25/10* (2006.01)

(52) U.S. Cl. ..... 220/580; 220/756

(58) Field of Classification Search ..... None
See application file for complete search history.

(56) References Cited

U.S. PATENT DOCUMENTS

| | | | | | |
|---|---|---|---|---|---|
| 206,271 | A | * | 7/1878 | Seybold | 215/237 |
| 926,163 | A | * | 6/1909 | Bauer | 99/347 |
| 1,978,025 | A | | 10/1934 | McGown | |
| 2,096,358 | A | * | 10/1937 | Gautier | 220/580 |
| 2,172,457 | A | | 9/1939 | Schwartz | |
| 2,524,588 | A | * | 10/1950 | Burkhardt | 220/315 |
| 2,726,012 | A | | 12/1955 | Jensen | |
| 3,784,051 | A | | 1/1974 | Shaw et al. | |
| 3,987,941 | A | | 10/1976 | Blessing | |
| 4,723,674 | A | | 2/1988 | Nunes | |
| 4,874,108 | A | | 10/1989 | Valasek | |
| 5,213,230 | A | | 5/1993 | Kral | |
| 5,339,981 | A | | 8/1994 | Kral | |
| 5,361,933 | A | * | 11/1994 | Oster | 220/578 |
| 2003/0190393 | A1 | | 10/2003 | Johnson et al. | |

* cited by examiner

*Primary Examiner*—Stephen Castellano
(74) *Attorney, Agent, or Firm*—Merchant & Gould P.C.

(57) ABSTRACT

An internal cover (10) is used for enclosing the contents of a straight walled container (38) which consists of a disc shaped rigid body (20) having a recess (22) in the top surface creating a depression with an outside rim (24) extending around the edge and at least one valve air vent opening (30) within the recess. The body also has a circumferential groove (26) with a lip seal (36) disposed within the groove for sealing the cover to a container's side walls. A bail handle (40) is rotatably affixed within the body recess and has least one valve bore (44) therethrough covering at least one air vent opening forming a valve. When the handle is rotated to a vertical position an air flow path is created permitting the cover to be inserted into a container. When the cover is resting on top of the contents the valve is sealed by rotating the handle to a horizontal position.

19 Claims, 5 Drawing Sheets

INTERNAL COVER FOR ENCLOSING CONTAINER CONTENTS

TECHNICAL FIELD

The present invention relates to lids for containers in general. More specifically to a valved cover that slides inside a straight walled container to enclose and cover the contents.

BACKGROUND ART

Previously, many types of lids and covers have been used in endeavoring to provide an effective means to either cover the top of a container or slide inside the container to cover the product. Many have developed covers for dry articles such as coffee, tobacco and sugar or liquids such as paint to prevent the hardened skin on the top. In most cases prior art has utilized some type of valve or simply vents to permit the air within the container to escape when applying the cover and to prevent a vacuum to be formed precluding removal.

A search of the prior art did not disclose any patents that possess the novelty of the instant invention; however the following U.S. patents are considered related:

| U.S. Pat. No. | Inventor | Issue Date |
|---|---|---|
| 1,978,025 | McGown | Oct. 23, 1934 |
| 2,172,457 | Schwartz | Sep. 12, 1939 |
| 2,726,012 | Jensen | Dec. 6, 1953 |
| 3,784,051 | Shaw et al. | Jan. 8, 1974 |
| 3,978,941 | Blessing | Oct. 26, 1976 |
| 4,723,674 | Nunes | Feb. 9, 1988 |
| 4,874,108 | Valasek | Oct. 17, 1989 |
| 5,213,230 | Kral | May 25, 1993 |
| 5,339,981 | Kral | Aug. 23, 1994 |
| Publication 2003/0190393 | Johnson et al. | Oct. 9, 2003 |

McGown in U.S. Pat. No. 1,978,025 teaches a coffee can vacuum attachment which consists of a disc member formed of relatively thin flexible rubber with its center curving upwardly permitting insertion into a coffee can. A valve member having a handle on top is stretched slightly so that it lays flat against the disc and when lifted up from its seat the valve port is opened permitting air to enter or escape above the coffee in the can.

U.S. Pat. No. 2,172,457 issued to Schwartz is for a cover used in dispensing containers for dry articles such as tobacco, coffee, sugar and the like. The cover is made of plastic and is slightly resilient and has air tight sliding contact with the inner surface of the container. A vent is provided that permits air to escape when installing or removing the cover.

Jensen in U.S. Pat. No. 2,726,012 discloses a flavor-protecting coffee cover for vacuum packed coffee. The cover includes a handle and a disc having a diameter slightly smaller than the can with a number of small apertures in the top wall thought which air may flow when the disc is installed or moved upwardly.

Shaw et al. in U.S. Pat. No. 3,784,051 teaches a closure member sealingly movable in the container in contact with the contents excluding air above the surface of the contents.

U.S. Pat. No. 4,874,108 issued to Valasek is for a sealer used with containers. The sealing portion has a handle attached and is capable of covering the surface of the substance within the container. The sealer is a flexible membrane with an O-ring at its circumference. The handle portion is also flexible and has a shaft portion with a top extending above capable of fitting entirely with in the container and is not required to be fastened when the container lid is affixed thereon.

Kral in U.S. Pat. Nos. 5,213,230 and 5,339,981 disclose a paint can sealer for sealing the surface of the contents within a container. The sealer consists of a disc-like member having a centrally located upstanding hollow handle with a purge valve at the upper end. The purge valve has a closed position for preventing egress of air upwardly thru the hollow handle and a open position for air passage. The disc-like member is contoured to correspond with the shape of the interior of the container. The purge valve located within the handle may be manually pinched to open permitting an air flow from the lower surface of the device to atmosphere.

For background purposes and as indicative of the art to which the invention is related reference may be made to the remaining cited patents issued to Blessing in U.S. Pat. No. 3,978,941 and Nunes in U.S. Pat. No. 4,723,674

DISCLOSURE OF THE INVENTION

The need for covering the contents of a container after the original lid has been removed has been with us for decades particularly since the general acceptance and utilization of containers having smooth straight interior walls. Attempts have been made in the past to fulfill the need however none have gained popularity with the public. It is therefore the primary object of the invention to provide a cover that is sturdy, easy to operate and completely excludes air from product in container between the original lid and the top surface of the product. The invention provides the capability of obtaining an air tight seal thereby completely eliminating the unwanted atmospheric air by replacing the air space with a sealed cover completely separate from the original lid.

An important object of the invention is therefore accomplishing the task by using a handle on top of an internal cover that attaches to a unitary rigid body and utilizes a lip seal on its periphery. The handle serves two purposes first to install and lift the body into or out of the container and second the handle contains an integral valve that permits air to escape from underneath. The handle only requires rotating for operation which is easily gripped by ones fingers and when installing into a container it is simply pushed downward and when removed the handle is straightforwardly gripped and pulled upward. The invention is simple to use as the valve operates almost automatically as the valve portion is open when the handle rotated into a vertical position and is closed when rotated flat. The handle is normally rotated flat when the cover is installed to allow the original lid to be replaced on the container, therefore even without further knowledge the valve is opened and closed at the appropriate time.

Another object of the invention is that the container may be sealed without spilling any contents regardless of height of product inside. The cover wipes the sides or scrapes the edges clean when installing thereby retaining the product under the cover as it is pushed down into place. The invention further maintains the seal when the product is stored in a bottom outlet container utilizing an outlet valve, since the level is automatically retained due to the negative pressure created by the removal of the product which pulls the cover down to a point of equilibrium with the seal continuing to function properly.

Still another object of the invention utilizes multiple vents that permit rapid operation in relieving both positive and negative pressure when installing and removing the cover. The number and size of the vents and bores that make up the valve may be increased to service large containers or in the case of small vessels a single set may be sufficient.

Yet another object is that the invention is sturdy enough in its construction to slightly compress the product removing as much air as possible when installing the cover protecting the flavor and prolonging shelf life of the product. The invention functions properly with liquids, powders or solids as long as the container has smooth and parallel side walls. The spun stainless steel canisters presently popular in this country are likely candidates for use with the invention.

A final object is that the invention is simple and inexpensive as there are only four separate components required; a body either injection molded of thermoplastic or formed of metal, a handle of similar material, a lip seal of resilient material such as silicone and one or more common O-rings. Once the initial tooling cost is amortized over a period of time the piece price is economical and due to the economies of number the overall price of the invention is well within the reach of the masses.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
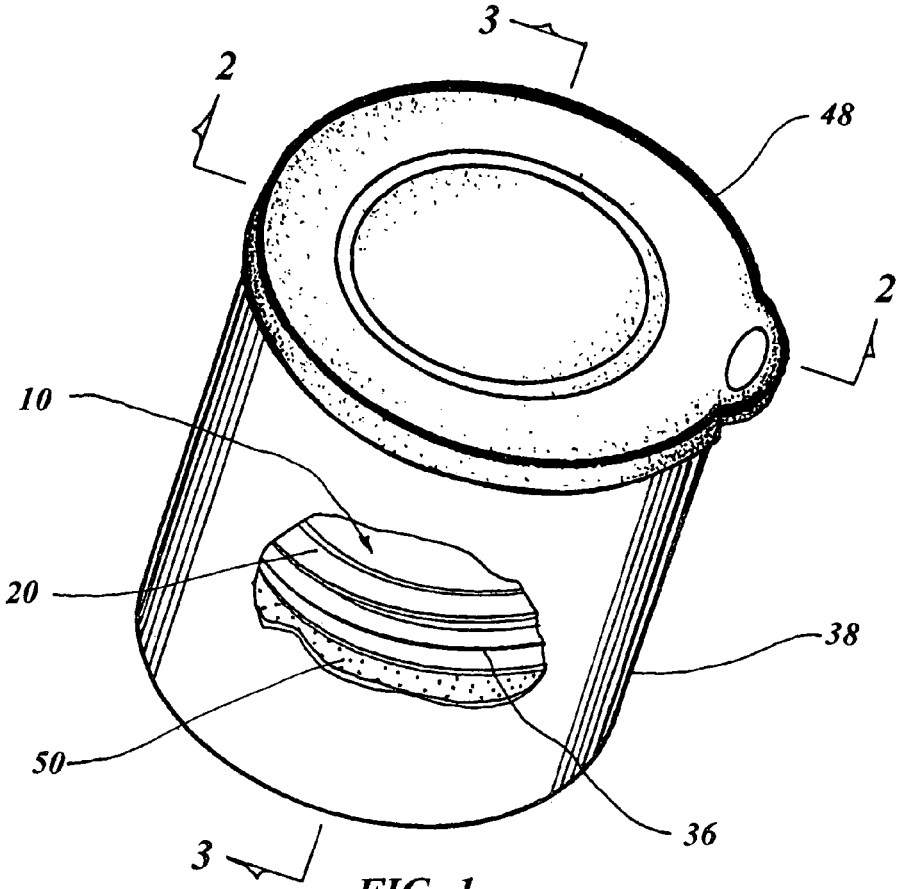
FIG. 1 is a partial isometric view of the internal cover for enclosing container contents partially illustrated inside a container with a lid and product inside the container.
Figure 12:
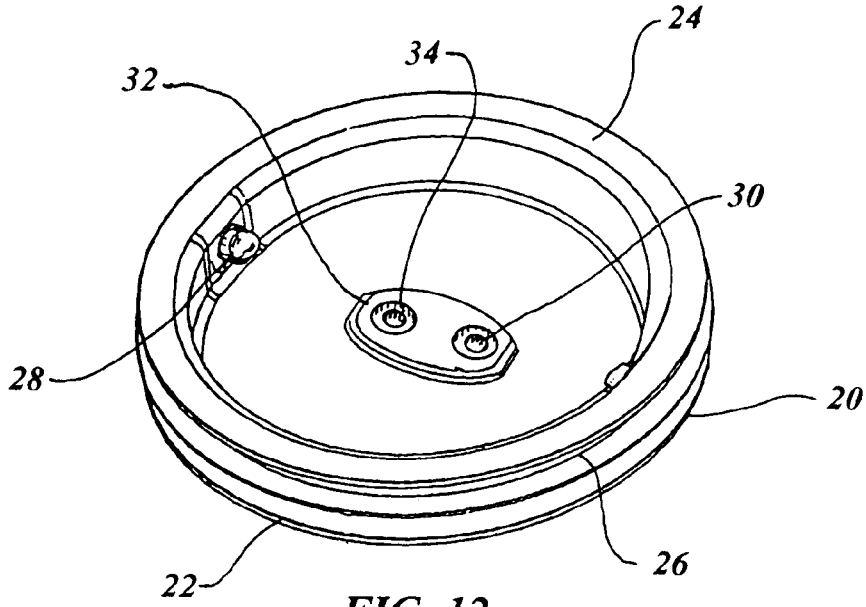
FIG. 12 is a partial isometric view of the internal cover body only in the preferred embodiment completely removed from the invention for clarity.

The best mode for carrying out the invention is presented in terms of a preferred embodiment. This preferred embodiment of an internal cover 10, for enclosing the contents of a straight walled container, is shown in FIGS. 1 thorough 22. The cover 10 is comprised of a disc shaped rigid body 20 having a diameter equivalent to a container inside surface, formed with a recess 22 on its upper surface leaving an upwardly extending rim 24 formed with a peripheral edge. The body's extending rim 24 includes a circumferential groove 26, illustrated best in FIGS. 12, 13 and 15, which extends completely around the body 20.

Figure 13:
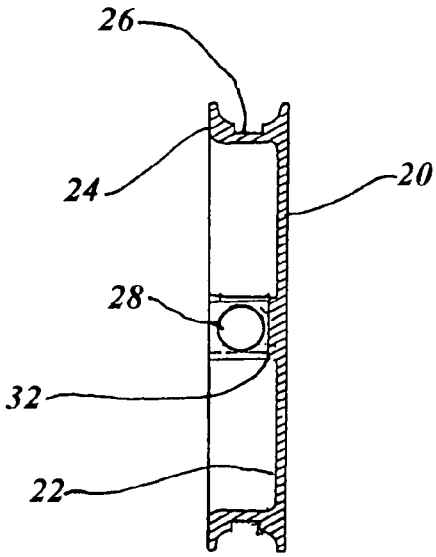
FIG. 13 is a cross sectional view taken along lines 13-13 of FIG. 14.
Figure 14:
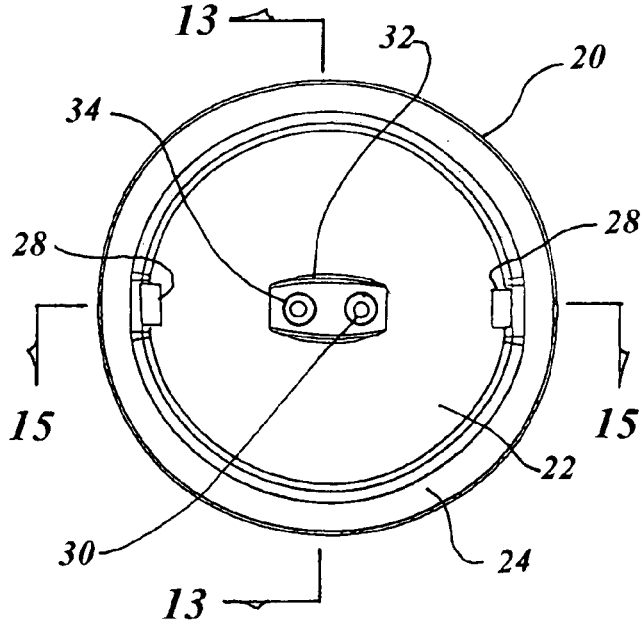
FIG. 14 is plan view in the preferred embodiment of the internal cover body completely removed from the invention for clarity.
Figure 15:
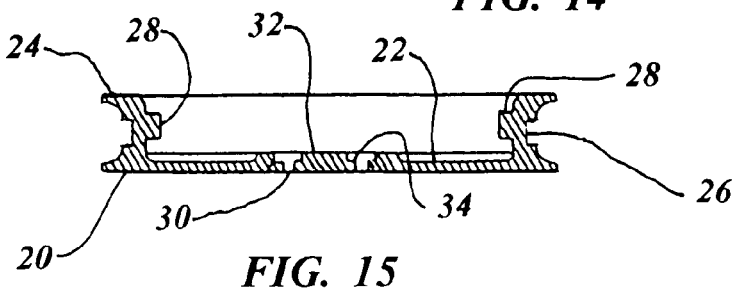
FIG. 15 is a cross sectional view taken along lines 15-15 of FIG. 14.
Figure 16:
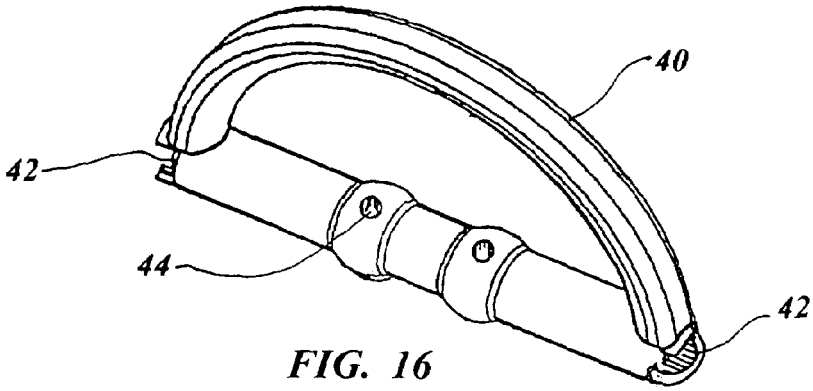
FIG. 16 is a partial isometric view of the internal cover bail handle in the preferred embodiment completely removed from the invention for clarity.
Figure 17:
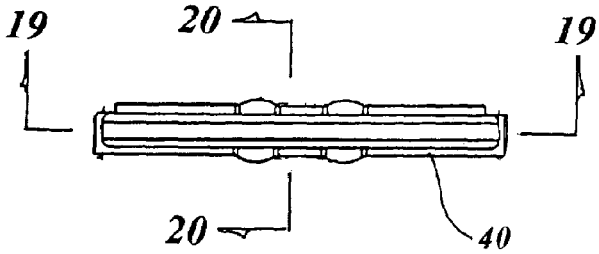
FIG. 17 is plan view in the preferred embodiment of the internal cover bail handle completely removed from the invention for clarity.
Figure 18:
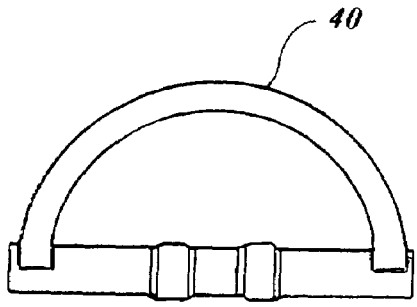
FIG. 18 is side view in the preferred embodiment of the internal cover bail handle completely removed from the invention for clarity.
Figure 19:
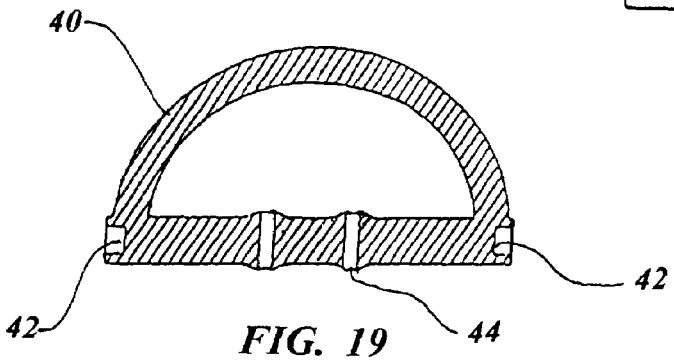
FIG. 19 is a cross sectional view taken along lines 19-19 of FIG. 17.
Figure 20:
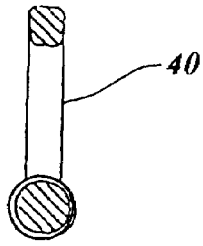
FIG. 20 is a cross sectional view taken along lines 20-20 of FIG. 17.

Opposed outwardly extending round protrusions 28 are formed within the body recess 22 for connection purposes. These protrusions 28 are made to form a pair that project inwardly towards each other as shown in FIGS. 13-15 and are positioned on an imaginary centerline. The body 20 also has at least one, but preferably two, valve air vent openings 30 within the recess 22. A raised flat platform surface 32 is centrally located on the upper surface of the body recess 22 and includes at least one, but again preferably two, countersunk holes 34 positioned on the same imaginary centerline as the protrusions 28 directly over the air vent openings 30

The internal cover body 20 may be formed from a plastic material such as acrylic, nylon, ABS, allyl diglycol carbonate, polycarbonate, polystyrene, polysulfone, polyester sulfone or polyester while alternately it may be formed or cast from metal such as stainless steel, aluminum, titanium or the like.

Figure 2:
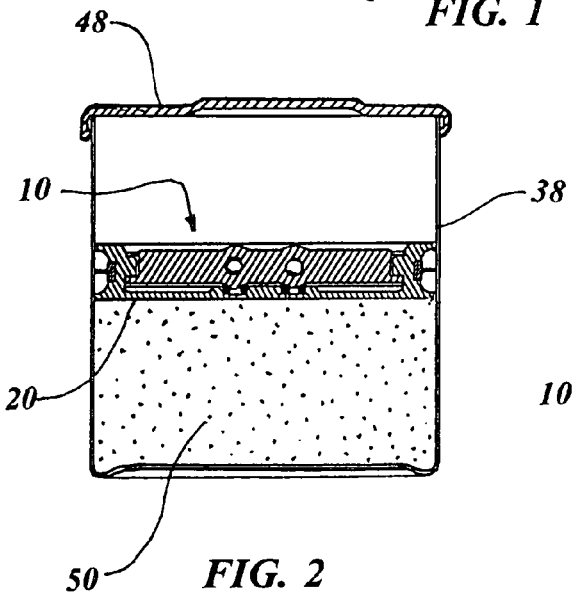
FIG. 2 is a cross sectional view taken along lines 2-2 of FIG. 1.
Figure 3:
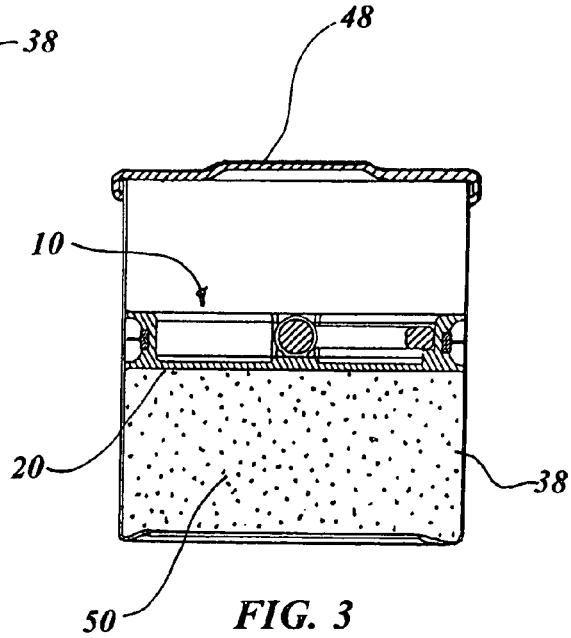
FIG. 3 is a cross sectional view taken along lines 3-3 of FIG. 1.
Figure 4:
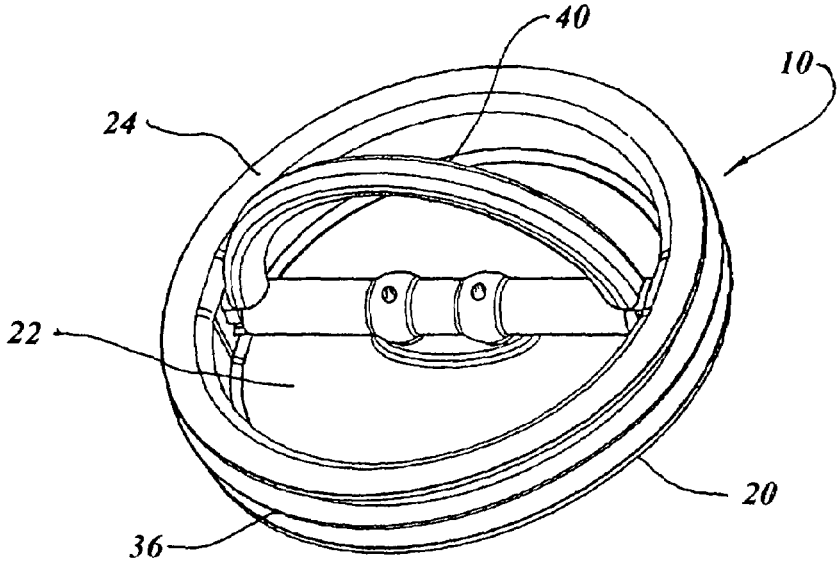
FIG. 4 is a partial isometric view of the internal cover for enclosing container contents with the handle in the open position of the preferred embodiment.
Figure 5:
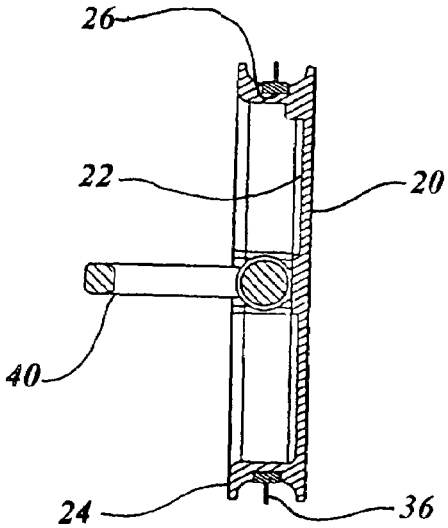
FIG. 5 is a cross sectional view taken along lines 5-5 of FIG. 6.
Figure 6:
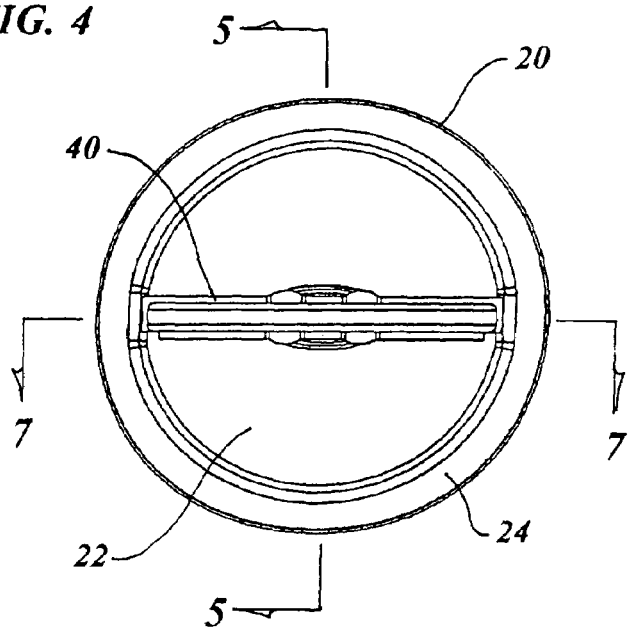
FIG. 6 is plan view of the preferred embodiment of the internal cover.
Figure 7:
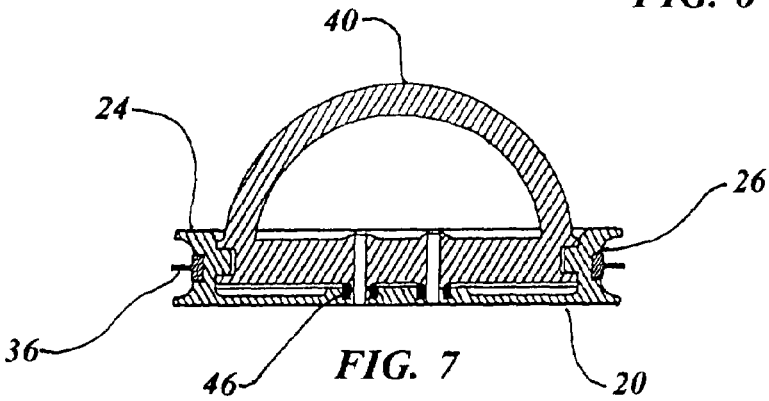
FIG. 7 is a cross sectional view taken along lines 7-7 of FIG. 6.
Figure 8:
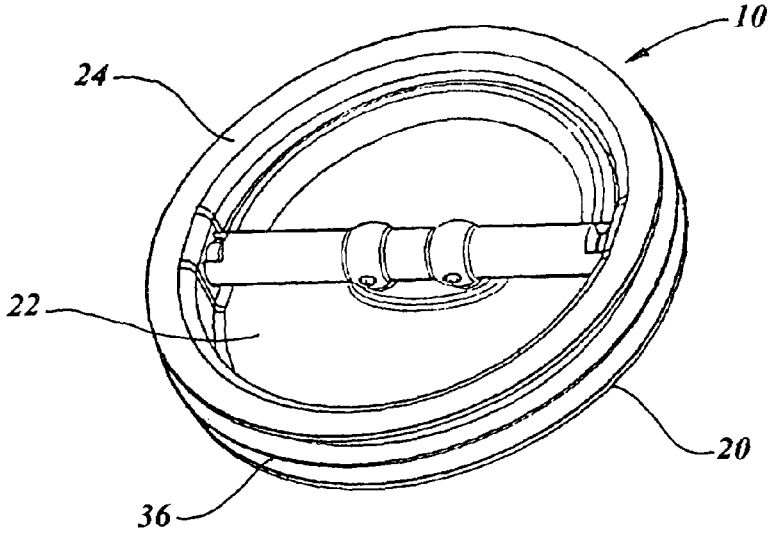
FIG. 8 is a partial isometric view of the internal cover for enclosing container contents with the handle in the closed position of the preferred embodiment.
Figure 9:
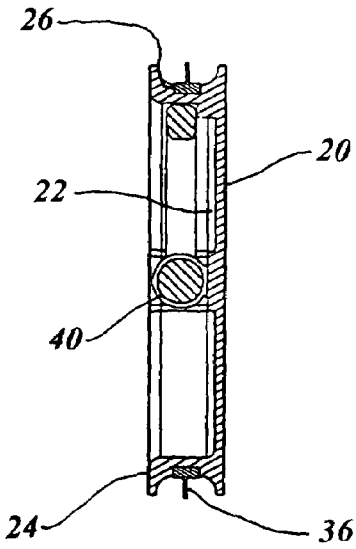
FIG. 9 is a cross sectional view taken along lines 9-9 of FIG. 8.
Figure 10:
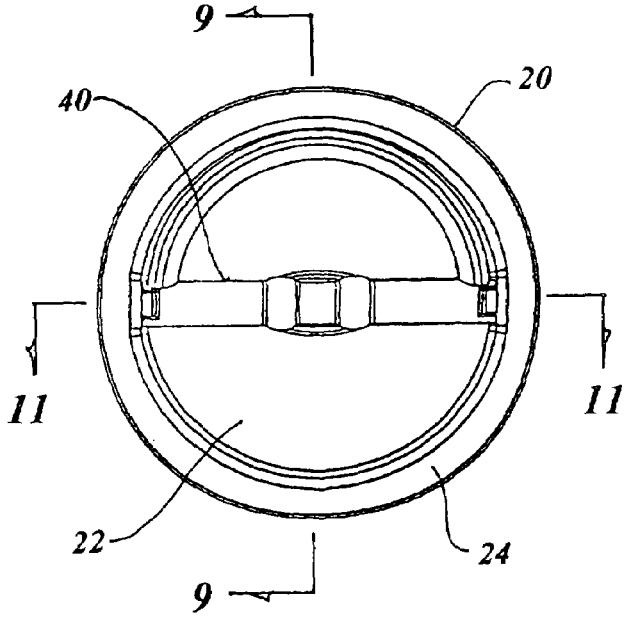
FIG. 10 is plan view of the preferred embodiment of the internal cover.
Figure 11:
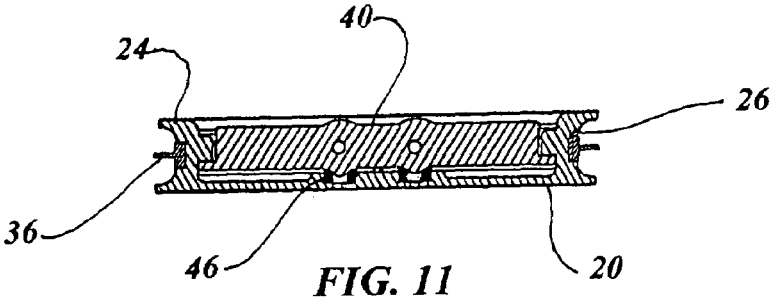
FIG. 11 is a cross sectional view taken along lines 11-11 of FIG. 8.
Figure 21:
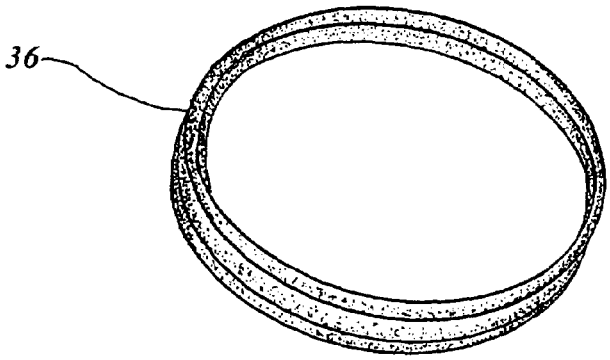
FIG. 21 is a partial isometric view of the internal cover lip seal in the preferred embodiment completely removed from the invention for clarity.

An elastomeric lip seal 36 forms the means for sealing the body to an inside surface of a straight walled container 38. The lip seal 36 is disposed within the circumferential groove 26 and is used for sealing the cover 10 to the side walls, as shown in FIGS. 1-3. The lip seal 36, illustrated by itself in FIG. 21, is formed in a T shape with the top of the T shape contiguously engaging the circumferential groove 26 in the cover body 20. The leg of the T shape sufficiently thin to deflect when pressed against an internal wall of the container 38, as illustrated in FIGS. 2 and 3, creating an air tight seal. The lip seal 36 may be formed from any resilient substance; however a silicone material is preferred.

A bail handle 40 is rotatably affixed within said body recess 22, and includes opposed inwardly extending sockets 42 that are configured to receive the outwardly extending round protrusions 28 that are contained in the body recess 22. The bail handle 40 is configured to snap into place, or the like, mating the protrusions 28 onto the sockets 42 permitting the handle 40 to freely rotate 180 degrees and fit flush within the recess 22 of the body 20, as illustrated in FIGS. 8-11.

The bail handle 40 has at least one but preferably two valve bores 44 as illustrated in FIGS. 4, 7, 11, 14, 16 and 19. The valve bores 44 extend through a horizontal section of the handle 40 covering the air vent openings 30 when the handle 40 is rotated to a horizontal position. When the handle 40 is rotated to a vertical position, the bore or bores 44 are aligned with the appropriate valve air vent opening 30 providing an air flow path therethrough. Opening the valve permits the cover 10 to be inserted into a container 38 with the bail handle 40 in the vertical position until the cover 10 rests on top of the contents of the container 40 thereby sealing the cover 10 in place when rotating the handle 40 to a horizontal position and nested within the recess 22 of the body 20. this action precludes communication between the bores 44 and air vent openings 30.

The bail handle 40 has an overall D shape with a round cross section around the bore or bores 44 and is preferably formed from a plastic material such as acrylic, nylon, ABS, allyl diglycol carbonate, polycarbonate, polystyrene, polysulfone, polyester sulfone or polyester. It is also possible to form the handle 40 of a metal such as stainless steel, aluminum or titanium.

Figure 22:
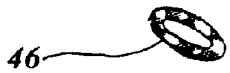
FIG. 22 is a partial isometric view of at least one O-ring in the preferred embodiment completely removed from the invention for clarity.

In order to create a seal between the bores 44 and air vent openings 30 an O-ring 46 is disposed within each countersunk hole 34 in the flat platform 32 of the body 20 forming a resilient air tight seal between the body 20 and the bail handle 40. The O-ring 46 is illustrated alone in FIG. 22 and installed in the countersunk holes 34 in FIGS. 7 and 11. It is preferred that the O-ring 46 is formed from a silicone material however other materials may be substituted according to the requirements of the material stored within the container 38.

The reason that one or more bores 44 and air vent openings 30, along with the O-rings 46 are specified is that for some applications a single bore 44, opening 30 and O-ring 46 is sufficient and in others two or more are more appropriate to permit the cover 10 to be installed and removed easily and quickly particularly in large containers 38. For the above reason and to illustrate the invention with a common conventional container such as a stainless steel canister, two bores 44, openings 30 and O-rings 46 are depicted in the drawings.

In operation a conventional lid 48 for the container is removed, the cover 10 is positioned over a container 38, the bail handle 40 rotated to the vertical position opening the valve and the cover 10 is manually pushed into the container 38 until it touches the product within. The bail handle 40 is then rotated to a horizontal position into the recess 22 of the body thereby closing the valve which seals the cover disallowing any air to enter the enclosed space within the container 38. When the contents of the container are to be used the conventional lid 48 is removed and the user inserts his or her hand and rotates the handle 40 to the vertical position providing a convenient gripping surface to grasp and lift the cover 10 from the container 38. Rotating the handle 40 also opens the valve and when the cover 10 is lifted the negative pressure created within the space is relieved through the valve permitting easy removal.

FIGS. 1-3 illustrate a representative product 50 that has been enclosed by the cover 10 in a typical stainless steel container 38 and the container includes a conventional plastic lid 48 well known in this country.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

The invention claimed is:

1. An internal cover for enclosing the contents of a straight walled container comprising:

a body having a diameter sized to be equivalent to a container inside surface, said body has a disc like shape with flat surfaces extending generally horizontally when the internal cover is placed within an upright straight walled container, said body has at least one air vent opening, means for sealing the body to an inside surface of a straight walled container, a bail handle rotatably attached to said body, and a valve integrally formed within said body and said handle permitting the cover to be inserted into a container until resting on top of the contents and sealing the cover in place with the valve, the valve having at least one valve bore defined by said bail handle, wherein when the handle is in a vertical position the valve is open aligning the at least one valve bore with the at least one cover air vent opening and the valve is closed when the handle is rotated flat against at least one of said flat surfaces of the body.

2. The internal cover as recited in claim 1 wherein the means for sealing comprises an elastomeric lip seal.

3. The internal cover as recited in claim 2 wherein said lip seal is formed in a T shape with the top of the T shape contiguously engaging the cover body and the leg of the T shape sufficiently thin to deflect when pressed against the internal wall of the container creating an air tight seal.

4. The internal cover as recited in claim 2 wherein said lip seal is formed from a silicone material.

5. The internal cover as recited in claim 1 wherein said body further has opposed outwardly extending round protrusions connecting the bail handle to the body in a rotatable manner.

6. The internal cover as recited in claim 5 wherein the bail handle further has opposed inwardly extending sockets configured to receive the outwardly extending round protrusions.

7. The internal cover as recited in claim 1 wherein said body further comprises a centrally located raised flat platform surface having at least one countersunk hole around said at least one air vent opening.

8. The internal cover as recited in claim 7 further comprising at least one O-ring disposed within said at least one countersunk hole in said body forming a resilient air tight seal between the body and the bail handle.

9. The internal cover as recited in claim 8 wherein said O-ring is formed from a silicone material.

10. The internal cover as recited in claim 1 wherein said body is formed from a plastic material selected from the group consisting of acrylic, nylon, ABS, allyl diglycol carbonate, polycarbonate, polystyrene, polysulfone, polyester sulfone and polyester.

11. The internal cover as recited in claim 1 wherein said body is formed of a metal selected from the group consisting of stainless steel, aluminum and titanium.

12. The internal cover as recited in claim 1 wherein said bail handle has an overall D-shape with a round cross section around at least one valve bore.

13. The internal cover as recited in claim 1 wherein said bail handle is formed from a plastic material selected from the group consisting of acrylic, nylon, ABS, allyl diglycol carbonate, polycarbonate, polystyrene, polysulfone, polyester sulfone and polyester.

14. The internal cover as recited in claim 1 wherein said bail handle is formed of a metal selected from the group consisting of stainless steel, aluminum and titanium.

15. An internal cover and a straight walled container, said internal cover enclosing the contents of said straight wall container, said internal cover comprising:

a body having an outer dimension equivalent to a container inside surface, the body having a height, the body including a centrally raised flat platform surface having at least one air vent opening which passes through the internal cover body;

a bail handle positioning the internal cover within the container and sealing the air vent opening, the bail handle having a handle portion and a horizontal portion, the handle portion having two ends which are connected to the horizontal portion, the horizontal portion having at least one bore hole, the horizontal portion being pivotably attached to the cover body such that the bail handle can be rotated about a horizontal pivot axis, the horizontal pivot axis being within the height of the internal cover body; and wherein the bail handle and the cover body are configured such that the air vent opening and the bore hole are in alignment when the bail handle is in a vertical or substantially vertical position aligned with a vertical upright axis of the straight walled container and wherein the bail handle seals the air vent when the bail handle is in a horizontal or substantially horizontal position extending perpendicular or nearly perpendicular to the vertical upright axis of the straight walled container.

16. The internal cover and straight walled container of claim 15 wherein the internal cover body has a recess and wherein the bail handle is entirely within the recess when the bail handle is rotated into the horizontal position.

17. The internal cover and straight walled container of claim 15 wherein the internal cover body has two air vents and wherein the bail handle has two bore holes.

18. The internal cover and straight walled container of claim 15 wherein the bail handle is formed from a single piece of material.

19. The internal cover and straight walled container of claim 15 wherein the body outer dimension is a diameter.

* * * * *